US007655109B2

(12) United States Patent
Manners

(10) Patent No.: US 7,655,109 B2
(45) Date of Patent: Feb. 2, 2010

(54) FLOOR COVERING LIFTING AND REMOVAL HAND TOOL

(75) Inventor: Herbert C. Manners, 220 Manners La., Punxsutawney, PA (US) 15267

(73) Assignee: Herbert C. Manners, Punxsutawney, PA (US)

( * ) Notice: Subject to any disclaimer, the term of this patent is extended or adjusted under 35 U.S.C. 154(b) by 509 days.

(21) Appl. No.: 11/368,737

(22) Filed: Mar. 6, 2006

(65) Prior Publication Data

US 2007/0204955 A1 Sep. 6, 2007

(51) Int. Cl.
*B32B 38/10* (2006.01)

(52) U.S. Cl. ..... 156/344; 156/584; 254/209; 254/211

(58) Field of Classification Search ..... 156/344, 156/584; 254/199, 200, 202, 203, 208, 209, 254/210, 211, 213, 219, 227, 242, 262; 294/8.6, 294/103.1, 104, 119.1, 902; 269/53, 54.5; 16/5

See application file for complete search history.

(56) References Cited

U.S. PATENT DOCUMENTS 1,186,729 A * 6/1916 Baker ..... 242/546.1
2,655,976 A 10/1953 Lovin
4,332,371 A 6/1982 Bell et al.
4,640,735 A * 2/1987 Murray et al. ..... 156/584
4,906,323 A 3/1990 Thomas
4,948,451 A 8/1990 Foltz
5,387,308 A 2/1995 Heavrin
5,415,725 A 5/1995 Scharf
5,454,899 A 10/1995 Glenn et al.
5,456,794 A 10/1995 Barrett
5,505,433 A * 4/1996 Carmichael et al. ..... 254/211
5,720,844 A 2/1998 Hanson
5,830,313 A 11/1998 Smith
5,891,298 A 4/1999 Kuroda et al.
5,909,868 A 6/1999 Galella
6,004,426 A 12/1999 Johnson
6,113,075 A 9/2000 McMichael et al.
6,199,616 B1 3/2001 Gillespie
6,371,401 B1 4/2002 Ketterer
6,386,476 B1 5/2002 Adleman, Jr.

(Continued)

OTHER PUBLICATIONS floorcovertools.com, Super Power Carpet Puller #444, http://www.floorcoveringtools.com/customer/product.php?productid=444&cat=&page=1, Jul. 27, 2005.

(Continued)

*Primary Examiner*—Mark A Osele
(74) *Attorney, Agent, or Firm*—The Webb Law Firm

(57) ABSTRACT

A floor covering lifting and removal hand tool for lifting an edge and removing a floor covering that is secured to a floor surface. An arcuate lifting base is formed with a grip end spaced from an opposite end and optionally including load distribution flanges across the arcuate lifting base. An upwardly extending lever arm joins to the arcuate base to rotate the base. The base further incorporates a releasable clamp that captures the edge of the floor covering. Anti-slip features are incorporated about a face of the base to contact the floor covering. In operation, the lever arm is rotated to overcome the force of the bond to lift and remove the floor covering from the floor surface. The lever arm is adjustable, removable, and is optionally ratchetable for use in confined spaces near walls and corners.

24 Claims, 3 Drawing Sheets

U.S. PATENT DOCUMENTS

| | | | | |
|---|---|---|---|---|
| 6,428,108 | B1 | 8/2002 | Chase | |
| 6,595,261 | B2 | 7/2003 | Fitterer | |
| 6,613,188 | B1 * | 9/2003 | Berg et al. | 156/344 |
| 6,840,299 | B2 | 1/2005 | Allen et al. | |
| 7,299,846 | B2 * | 11/2007 | Peirce | 156/584 |
| 2004/0026045 | A1 * | 2/2004 | Adleman, Jr. | 156/584 |
| 2007/0246167 | A1 * | 10/2007 | Goupil | 156/584 |

OTHER PUBLICATIONS

Eugen Lägler GmbH, Reno Floor Removing Machine, http://www.laegler.de/html__e/p__reno__te.htm.
Lorenzi, Neal, Flooring Removal Simplified, http://plantservices.com/Web__First/ps.nsf/ArticleID/NLOI-4RPUKY/, Mar. 19, 2004.
Sparks Belting Company, Dura Drive Plus Technical Manual, http://www.sparksbelting.com.

* cited by examiner

FLOOR COVERING LIFTING AND REMOVAL HAND TOOL

BACKGROUND OF THE INVENTION

1. Field of the Invention

The invention advances the state of the art of removing floor coverings such as carpets that are glued or fastened to a floor surface.

2. Description of Related Art

Floor coverings have been in use for the duration of recorded history. In more recent centuries, floor coverings have become more durable, and more suitable for use in residential and commercial high-traffic pedestrian areas. Those skilled and knowledgeable in the related fields of technology have long understood that such high-traffic environments establish unfavorable wear conditions for carpeting and other types of floor coverings. Many problems have resulted and include accelerated wear and deterioration. Some of this type of damage occurs as a result of unwanted shifting of the floor covering during use due to the movement of individuals, furniture and equipment.

Attempts to reduce wear due to undesired shifting have led to efforts to fasten the floor covering to the sub-floor. Fastening methods have included adhesive materials and mechanical fasteners. In more recent decades, advances in the state of the art of such fastening techniques have borne improved glues, and improved nails, tacks, staples, and combinations thereof. These fastening methods have matured and now ensure very strong and permanent interfaces that join the floor covering to the subjacent floor surface.

Despite improvement in the wear and damage that results from better fastening methods, floor coverings still see wear and unavoidable deterioration over time, which necessitates removal and replacement. Eventually, all floor covering layers must be removed to expose the sub-flooring or underlayment, so that a new floor covering can be installed. Similar problems persist with other types of covering materials, including, for example, removing roofing materials from roofing decks, and removal of interior and exterior wall and facade coverings, all of which have benefited from improved fasteners, adhesives, and combinations thereof.

The capability to remove a floor covering that is secured to the sub-floor using newer fastening techniques has become more difficult with each advance in fastening technology. In turn, the ever increasing difficultly has led to the need for more capable removal methods and technologies and those endeavoring in the related arts have continually attempted to improve the capabilities of hand-actuated tools.

In one attempt to improve carpeting removal tools, U.S. Pat. No. 6,199,616 to Gillespie describes a carpet remover that is limited to a rotary power drive that is adapted to drive a shaft that turns to peel and lift a carpet as the shaft turns.

The Gillespie shaft is formed with at least two clamps that grip an edge of the carpet as it is pulled away from the floor and rolled onto the shaft. Gillespie concedes that firmly glued carpet requires a shorter shaft so that more force is available to pull the carpet away from the floor, which requires more time to remove the carpet in smaller sections.

Further, for floor coverings such as carpets that are glued down very securely, Gillespie appears incapable of imparting adequate force to pull the carpet from the floor. As described, the shaft is adapted with a small moment arm in view of the small diameter shaft. Another issue inadequately addressed by Gillespie is that carpet removal must periodically cease as the carpet accumulates onto the shaft and must be removed.

The spooled carpet is also heavy, which also increases the force needed to turn the shaft. Further, the shaft is better adapted to remove only small sections of carpet at a time due to the limited length of the shaft.

U.S. Pat. No. 6,386,476, to Adelman, Jr. describes another variant of the Gillespie device. As before, Adelman is restricted to a rolling shaft device that clamps an edge of the carpet and spools it onto the shaft as the carpet is pulled away from the floor. With these and other devices, it remains very challenging to remove carpets and other floor coverings that have been securely fastened to the floor surface, sub-floor, or underlayment.

Also, while many types of complex and expensive machines have also been devised, improvements remain wanting for hand removal tools. Smaller hand tools are needed for many reasons and to remove floor coverings in confined spaces and areas with minimal available clearances. Further, improvements are needed to increase the ease with which an edge of a floor covering may be lifted from a floor surface so that large sections may be gripped for easier removal by larger devices.

What has been needed and as yet unavailable, is a floor covering lifting and removal hand tool that enables easier removal of carpeting and other floor covering materials, as well as other types of coverings, which have been glued down or otherwise firmly secured to the subjacent surface. One notably useful feature that is needed in such a hand tool is a better way to overcome the bond of a strong adhesive and a mechanically secured interface between the floor covering and the floor surface. Such problems are pronounced with coverings from staircases, which can use glues and mechanical fasteners such as nails, staples, and screws. Also needed is an improved hand tool for use in confined spaces, and locations proximate to corners, walls, and narrow hallways, all of which can have floor coverings that are attached very securely. Such limited clearance areas present removal problems that are challenging because of close proximity to other structures, like walls, and interfere with the removal efforts.

In any of these contemplated scenarios, the devices of the prior art have little to offer in the way of a good method for starting the removal operation. More specifically, one of the key challenges that persist is that to remove a floor covering such as a carpet, users first must get a grip on an edge of the floor covering. To impart these gripping forces, the user must first lift such an edge from the floor surface before the removal operation can commence.

With most of the prior art devices, it is assumed that the user has already lifted a portion of the floor covering near such an edge. With that portion already lifted away from the floor surface, the prior art devices must be clamped onto the lifted section before removal can begin. In this way, a larger section of the floor covering can be attached to the removal apparatus so that removal can get underway more readily.

Accordingly, one necessary improvement needed by those skilled in the art is an improved tool for lifting the edge of the well-secured floor covering, to enable larger sections to be lifted and removed from the sub-floor more easily than has been previously possible. Such a new tool would more preferably also have the capability for enhanced ease of use in areas previously inaccessible with prior tools, such as stairs, ramps, narrow hallways, closets, and other similarly confined areas. Additionally, it would be even more preferable for such an improvement to be well adapted for use in the most commonly encountered areas that are in close proximity to structures such as walls, floor mounted fixtures, and other appurtenances that limit clearance for use of removal tools.

SUMMARY OF THE INVENTION

The devices according to the present invention overcome the problems of the prior devices in new and novel ways that offer many less complicated ways to lift an edge of and to remove a floor covering during a removal operation. In one preferred embodiment of the apparatus of the invention, a floor covering lifting and removal hand tool is contemplated, which is optimized for pulling an edge of a carpet or other sheet-type floor covering. In other even more preferred configurations, the floor covering lifting and removal hand tool is adapted for use as a stand-alone device that can be used to remove small sections and/or entire spans of a floor covering.

The innovative floor covering lifting and removal hand tool preferably incorporates an arcuate lifting base or rocker that is formed with a grip end spaced apart from a pivot joint that connects to a lever arm or handle extending therefrom. The arcuate lifting base or rocker can be formed in many shapes and arrangements, and can preferably have a semi-circular shape. The pivot joint is preferably configured with a pivot coupler that is fastened to the base, and which may include load distribution flanges that extend about the joint and across the arcuate lifting base. Depending upon the application and degree of force needed, or lever arm mechanical advantage that is to be exerted upon the floor covering, the contemplated flanges may not be needed for light duty use, and can be augmented with added flanges and a variety of other strength increasing features for heavy-duty applications.

For use in such heavier duty circumstances, the lever arm or handle can also be preferably adapted as an elongated and telescopically adjustable pole with the handle at one end. In other more preferred variations, the adjustability of the pole may also be accomplished with sectional, connectable rods that are added as needed to increase the length according to the lever action or mechanical advantage force required. In any configuration, the lever arm is at one end fixedly or removably connected to the pivot coupler and extends outwardly therefrom to the handle. The telescopic or sectionally adjustable connector rod configurations may be incorporated alone or in combination as part of the adjustable handle variation.

The floor covering lifting and removal hand tool also includes at least one releasable retainer that is attached to and or carried from the grip end of the arcuate base. The releasable retainer can have many possible constructions, but is preferably adapted with a clutch and or a clamping device or mechanism, which is most preferably configured to capture and clamp onto or retain the floor covering edge. With these features, the releasable retainer is adapted to prevent release of the floor covering edge, during operation, so that tension may be applied to the floor covering as the floor covering edge is pulled. In this way, the preferred embodiments of the floor covering lifting and removal hand tool can pull a floor covering, such as a carpet, away from a floor surface.

In variations of the arrangements of the invention, the releasable retainer of the floor covering lifting and removal hand tool may also be modified to incorporate a movable catch or pawl assembled into the clutch or clamp, which has a free engagement end adapted to grab the floor covering edge when it is received in the retainer. Further, a bias member is also preferably positioned against the catch or pawl to urge the engagement end against the floor covering as the floor covering edge is received and thereby captured in the releasable retainer. With the catch or pawl urged against the floor covering, the covering edge is captured and tension may be communicated to the floor covering by moving the lever arm to rotate the arcuate base.

The free end of the movable catch or pawl may be further adapted with gripping spikes and or a friction material such as a rubber pad or finger that can engage the floor covering to prevent release when the hand tool is used to pull the floor covering edge. In this modified arrangement, the floor covering may be released as needed by moving the catch or pawl against the force of the bias, member, which will disengage and release the floor covering edge from the releasable retainer.

To hinge the catch or pawl in the releasable retainer clutch mechanism, a rod or axle or shaft may be assembled into and or carried from the grip end, and may have the entire clutch component and or just the catch or pawl hinged thereon. The bias member can take many forms and may be a spiral wound spring received on the rod or shaft, having at one end an extension finger biased against the clutch and or against the grip end, and with the other end having another extension finger urging against the catch or pawl member.

In one of many possible variations of the releasable retainer wherein the clutch is adapted to receive and capture the floor covering edge, the releasable retainer may further be formed with a plurality of walls that are arranged to define a clutch recess. The clutch recess is sized to receive and surround a portion of the floor covering edge and may have a generally "U" shaped configuration. More preferably, one of the walls of the plurality is generally positioned to have an outward end that extends towards the catch or pawl to cooperate therewith and to constrain the range of motion of the catch or pawl. Even more preferably, the outward end and the catch or pawl cooperate together to receive and capture the floor covering edge wherein the floor covering edge is sandwiched between the catch or pawl on one side and the outward end on the opposite side.

In additional variations to any of the contemplated embodiments of the invention, the clutch or the releasable retainer may also further include a clamp that is analogous to a clamp mechanism having one or more movable jaws or arms. In this preferred or optional modification, the clamp may have at least one movable jaw that is spaced apart from and movable toward the grip end. In this option, the movable jaw or arm coacts with the grip end to define the clutch recess, which is sized to receive and capture the floor covering edge to sandwich the floor covering edge therebetween. In another alternative arrangement, the clamp may incorporate another jaw, movable or fixed in position, which is mounted to and or carried from the grip end, together with the earlier described movable jaw.

To improve the use and control of the floor covering lifting and removal hand tool, the arcuate lifting base may be adapted to incorporate friction-enhancing features that minimize slipping of the base relative to a surface of the floor covering.

In yet more alternative modifications to any of the embodiments of the invention, the floor covering lifting and removal hand tool may be further modified to incorporate a ratcheting lever arm that extends outwardly from and that is hinged to the pivot coupler. Preferably, the ratcheting lever arm may be moved about and is positionable over a predetermined range motion. With this modified ratcheting lever arm configuration, a ratcheting mechanism is contemplated that enables free movement of the outwardly projecting portion of the lever arm or adjustable handle in one direction, without movement being imparted to the arcuate base, while movement of the ratcheting lever arm in the opposition direction imparts force upon and movement to the arcuate base.

In this way, the floor covering lifting and removal hand tool according to the invention can be used in confined and close quarter areas where an edge of a floor covering or an entire section of a floor covering must be lifted away from a floor surface and removed therefrom. With this embodiment, a user may position the floor covering lifting and removal hand tool in a tight corner and or proximate to a floor covering edge to be lifted away from the floor surface.

The floor covering lifting and removal hand tool of the present invention can be modified in a number of ways for use for removing floor coverings such as carpet, and may incorporate any and all of the described features and capabilities. In operation, the contemplated floor covering lifting and removal hand tool of the invention is used to lift an edge of a floor covering, such as a carpet, by first positioning the hand tool proximate to a section of the floor covering to be removed.

For example, the floor covering hand tool is preferably positioned whereby its grip edge is arranged proximate to an edge of the floor covering. Next, the edge is received in the clutch recess of the releasable retainer for capture therein. The clamp or clutch components are fastened about and or clamped onto the edge. The lever arm and or adjustable handle are actuated or moved to rotate the arcuate base approximately about the pivot point and away from the original position of the edge. Typically, the lever arm is rotated and or moved generally around the pivot joint and toward the floor surface, which in turn moves the grip end of the base up from the floor surface to apply tension to and pull the floor covering away from the floor surface.

After a desired edge and or section of a floor covering has been pulled away from the floor surface, the tension is released by rotating or moving the lever arm and or adjustable handle in the reverse direction and toward the floor covering edge. With the tension released, the catch or pawl can be urged against the force of the spring or biasing members and away from the floor covering edge, which thereby releases the edge of the floor covering from the clutch. In alternative arrangements that use a clamp, the clamp or clamp jaw or jaws are opened to release the edge. Thereafter, the method is repeated as needed to continue removing the floor covering.

Many combinations and modifications of each of the proposed embodiments and variations thereof will also become apparent to those skilled in the art with reference now to the various drawings and illustrations of the invention in connection with the detailed descriptions of the embodiments of the invention.

BRIEF DESCRIPTION OF THE DRAWING(S)

DESCRIPTION OF THE PREFERRED EMBODIMENTS

Figure 1:
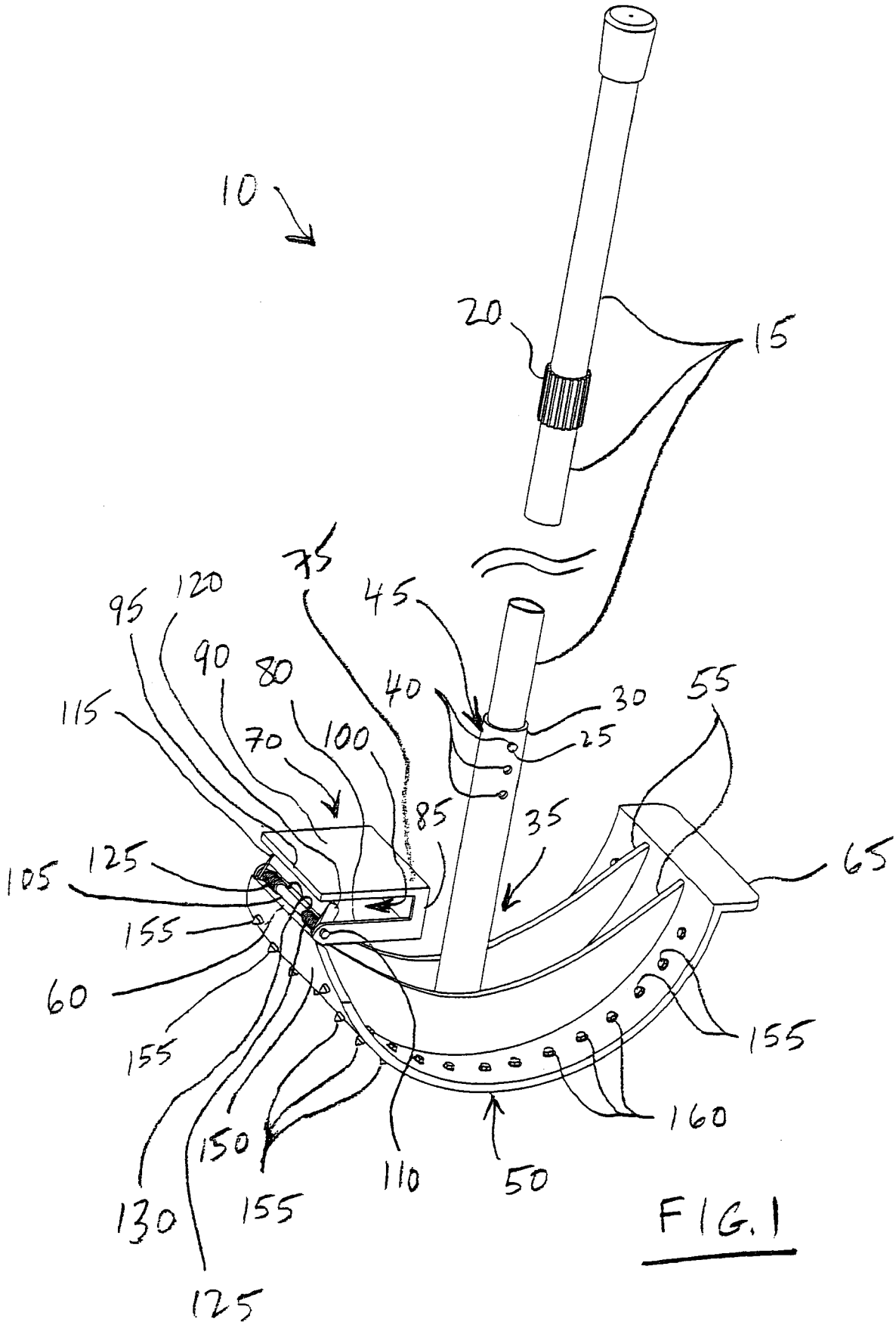
FIG. 1 is a top perspective view of a floor covering lifting and removal hand tool according to the principles of the invention.
Figure 2:
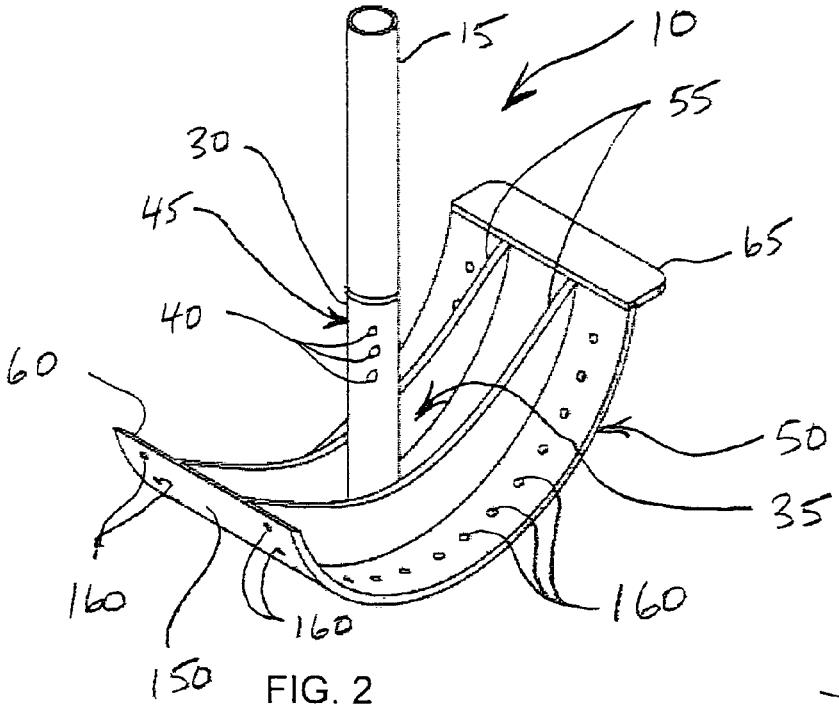
FIG. 2 is another top perspective view of the side view of the floor covering lifting and removal hand tool of FIG. 1 with certain structure removed for illustration purposes.

With reference now also to the various figures and specifically to FIGS. 1-4, an embodiment of the inventive floor covering lifting and removal hand tool 10 is illustrated. In this configuration, the hand tool 10 is illustrated as including a lever arm or handle 15 extending outward and being adjustable with telescopic twist-lock element 20, which is configured to loosen for varying the length of the lever arm or handle 15, and to tighten to fix the length in position for use of the hand tool 10. This arrangement establishes a lever arm capability that improves the utility of the hand tool 10.

The lever arm or handle 15 may be fixed directly to the hand tool 10, or may be releasably joined to with a threadable end (not shown) or by incorporating at least one spring biased plunger or ball pin 25. In latter configurations, the handle 15 is telescopically secured in a bayonet end 30 of a pivot joint 35 that is mounted on or integrally formed in the hand tool 10. The bayonet end 30 of the pivot joint 35 may have or be preferably adapted with thread elements (not shown) or with one or more apertures 40, to releasably fasten the handle 15 to the hand tool 10. The apertures 40 cooperate with the plunger or pin 25 to join the handle 15 to a pivot coupler 45 fastened to the hand tool 10 about the pivot joint area 35. Further, additional plungers or pins 25 may be incorporated on the handle 15 and additional apertures 40 may be formed in the bayonet end 30 of the pivot joint 35 to strengthen the interface between the handle 15 and the hand tool 10. More preferably, these apertures 40 may also be arranged to adjust the length of the handle 15 relative to the hand tool 10.

Adjustability of the length of the handle 15 modifies the force imparted by the hand tool 10 on the floor covering FC (FIG. 3) as a linear function of the length of the handle 15. Such adjustability and releasability of the handle 15 may also be accomplished using a number of other and related technologies well known to those skilled in the arts. Although not reflected in the figures in more detail, the handle 15 may be further adjustable about other segments of its length to alternatively use twist-lock, telescoping, spring plunger, and related features that have long been used to establish adjustable length handles. Such features are disclosed, for purposes of example and without limitation in U.S. Pat. No. 4,345,351 to Moss et al.; U.S. Pat. No. 4,524,484 to Graham; U.S. Pat. No. 4,653,142 to Upton; and U.S. Pat. No. 4,793,646 to Michaud, Jr., which are hereby incorporated by reference in their entirety as though fully set forth herein.

Additionally, the handle 15 may be releasably interchangeable to enable use of different length handles that may be preferred for use in spaced confined applications. The handle 15 may also further be adapted for use in a permanently fixed joint with the pivot coupler 45, or telescopically, threadably, or otherwise releasably joinable, multiple sections that can be joined together end-to-end to adjust the overall length of the combined modified handle.

As described generally above, the pivot joint 35 is more preferably configured in to have the pivot coupler 45 selected to be of a tubular form that defines the bayonet end 30, which receives and fastens to the handle 15. Other variations of the invention contemplate the handle 15 and the bayonet end 30 to have either male or female cooperative components, such as threaded or telescopically fitting features, which can fasten the handle 15 and the end 30.

Even further modifications to any of the preferred embodiments include variations of the pivot coupler 45 that extend outwardly from the hand tool 10 with an increased length to form an extended pivot coupler and lever arm or handle 45 that can be used in place of the handle 15 or in combination therewith. The pivot joint 35 is optionally formed by the pivot coupler 45 and fastened to or integrally formed in the hand tool 10 about a substantially arcuate lifting base or rocker 50 and is fixed in a generally central or slightly offset from center position of the arcuate rocker 50.

For use in heavy-duty applications requiring substantial forces to be imparted by the hand tool 10, one or more optionally preferred stress or load distribution or transfer flanges, ribs, and stiffening webs 55 may be included. The flanges 55 may be arranged to span part of or the entire arcuate rocker 50. Such a flange or each of a plurality of such flanges couple or communicate the force induced on the hand tool by actuation of the handle 15 across the pivot joint 35 and about the arcuate rocker 50.

This load distribution capability, among other features, enables the hand tool 10 to endure far higher forces than is possible with most prior art devices. As a result, far greater pulling power can be transmitted to the floor covering FC for removal. Depending upon the application and degree of lifting and removal force or the lever arm action force that is needed, the load distribution flanges 55 can be augmented with increased thickness or with additional strengthening features. For lighter duty applications, flanges 55 may even be minimized, and in some applications altogether eliminated.

The arcuate rocker base 50 is further configured with a first or grip end 60 about which is mounted any of a number of preferable capture and retaining features that are configured to securely grasp an edge E (FIG. 3) of the floor covering FC. The grip end 60 is preferably offset from the centrally disposed pivot joint 35 and across the arcuate rocker 50 between about 45° and 135° or more preferably by approximately 90° of arc distance, or more or less depending upon the preferred geometry of the arcuate base 50. This adaptation can optimize the mechanical advantage which can be predetermined according to the selected length of the lever arm. Opposite the grip end 60 and preferably on the other side of the pivot joint 35, is a second end or a step and or fulcrum end 65. Preferably, the end 65 is offset between about 45° and 135° or more preferably by approximately 90° of arc distance. In this preferred variation, the distance may be increased or decreased depending upon the application and preferred configuration of the hand tool 10.

As illustrated in the various figures, the fulcrum end 65 preferably may be configured as a footstep to augment the force that may be imposed on the tool 10 with the lever arm or handle 15 or the extended length pivot coupler lever arm or handle 45. In these optionally preferred arrangements, the user may increase the lever arm and pivot action by stepping on the fulcrum or step end 65 while moving the handle 15 during removal of the floor covering FC.

The substantially central arrangement of the handle actuated pivot joint 35 between the offset first or grip end 60 and the arcuate rocker 50, and the offset distance therebetween, combine to enable a pivoting fulcrum and lever system to establish the noted mechanical advantage, which is of particular utility to the present invention. As those skilled in the relevant fields of technology should appreciate, the mechanical advantage is linearly proportional to handle length, and to the distance between the pivot joint 35 and the first or grip end 60. It follows to those with knowledge in the field that an increase in handle length or a decrease in the distance between the pivot joint 35 and the grip end 60 will also increase the mechanical advantage and the ease of operation of the hand tool 10. Additionally, the offset distance of the second end or step and or fulcrum end 65 and use as a step can further augment the mechanical advantage.

With the curved configuration of the arcuate base 50, the actual linear distance between the grip end 60 and the pivot joint 35 can be minimized beyond what is possible with non-curvilinear configurations. Accordingly, although the instant invention is depicted in the various figures to have a substantially circular or semi-circular arcuate rocker or base 50, other higher or lesser curvatures may be found to further optimize the mechanical advantage by further lessening the distance between the grip end 60 and the pivot joint 35. With these various configurations, a means for establishing a lever arm to impart a fulcrum-type lever arm action on the arcuate lifting base 50 is established in a variety of new and useful ways.

The floor covering lifting and removal hand tool 10 also preferably incorporates at least one releasable retainer 70, which is fastened to and or carried from the grip end 60 of the arcuate base 50. In some of the many possible adaptations of the proposed releasable retainer 70, a clutch and or a clamping device or mechanism 75 is included. The clamp or clutch 75 in one optionally preferred embodiment has a pivotable mount side wall 80 fastened to the grip end 60 at one end, and with an upstanding back stop or wall 85 at the other.

The upstanding back or wall 85 is complemented with a third, outer clutch wall 90 that extends away from the backstop wall 85 to a free end 95. In this way, the plurality of walls 80, 85, and 90 are arranged to define a generally "C" or "U"-shaped clutch recess 100. The plurality of walls 80, 85, and 90 further define the clutch recess 100 to be sized to receive and surround a portion of the edge E of the floor covering FC therein.

The pivotable mount side wall 80 is fastened to the grip end 60 with a hinge shaft, axle, or rod 105 that may be formed as a bolt threadably captured by a nut 110 between at least two of the flanges 55 proximate the grip end 60. The clutch 75 may also further include a movable catch, pawl, or capture latch 115 that is pivotally received about the hinge bolt 105 and which extends to a free engagement end 120 towards the free end 95 of the clutch wall 90. The free engagement end 120 being thereby deflectable as the edge E is received into the clutch recess 100.

More preferably, the catch, pawl, or capture latch 115 is sized whereby it is movable within the confines of the clutch recess 100, but is constrained and cannot move outward beyond the free end 95 of the clutch wall 90, which establishes a stop to limit the range of motion of the catch, pawl, or capture latch 115. In addition, the free engagement end 120 of the movable catch or capture latch 115 is preferably shaped to grab the edge E of the floor covering FC, which can be accomplished with a generally pointed end 120 or by other means such as integral or attached gripping elements or features.

One configuration of the movable catch or pawl 115 comprehends a flexible yet substantially rigid catch or pawl 115 fixed in position and urged against the free end 95 of the clutch wall 90. As the edge E of the floor covering FC is received into the clutch recess 100, the free engagement end 120 of the catch or pawl or capture latch 115 deflects, resiliently bends, or is adapted to flex enough to enable receipt of the floor covering edge E into the clutch recess 100. Once received, the edge E of the floor covering FC is engaged and captured as the catch or pawl end 120 coacts with the wall free end 95 to grip covering edge E. In other words, the sandwiched interaction of the engagement end 120 of the catch or pawl or capture latch 115, thereby grabs and urges the floor covering edge E against the free end 95 of the third, clutch wall 90 as the hand tool 10 is activated to pull the covering FC.

During such operation, the lever action force imparted by the handle 15 is transmitted to the edge E of the floor covering FC, which establishes a tensile force on the floor covering FC.

This tension lifts and removes the floor covering FC from the floor surface or underlayment "FS" (FIG. 3) during use and operation of the hand tool 10.

In another preferred variation, the capture latch or movable catch or pawl 115 is substantially more inflexible, but is pivotably hinged about the grip end 60 of the arcuate base 50, and more preferably is hinged about the hinge bolt 105 to deflect. In this variation, an arcuate leaf spring or a spiral wound or coil-type spring or other type of bias member 125 is similarly attached to the grip end 60 of the arcuate base 50.

The bias member 125 in its coil spring form preferably includes at least one extension finger 130 that extends toward, and which exerts a bias force against the catch or pawl or capture latch 115. Another part of the bias member 125 may be secured to grip end 60, the hinge bolt 105, the mount side wall 80, or a combination thereof, which counters the force applied to the catch or pawl or capture latch 115. More preferably, the bias member 125 is received on the hinge bolt 105 and positioned to urge the free engagement end 120 of the capture latch or catch or pawl 115 against the free end of the outer clutch wall 90.

A number of additional modifications are contemplated by the present invention wherein the free engagement end 120 of the capture latch 115 also incorporates friction elements. The free engagement end 120 of the capture latch 115 is also more preferably adapted with additional friction elements that can augment its gripping and capturing capability. Some optionally preferred friction features can include, for purposes of non-limiting examples, sharp fingers or spikes, a roughened surface, high friction coating such as a rubberized coating, notches, serrations, and the like, which can be used alone or in combination to further improve the engagement capability of the capture latch 115.

After use, the orientation of the hand tool 10 is changed to discontinue the application of force on the edge E of the floor covering FC. Next, the catch or pawl or capture latch 115 may be manually urged against the force of the bias member 125 and away from the free end or edge 95 of the clutch wall 90, and toward the mount sidewall 80. This disengages the releasable retainer 70 and the clutch 75 from the edge E of the floor covering FC, which may then be removed therefrom.

Figure 3:
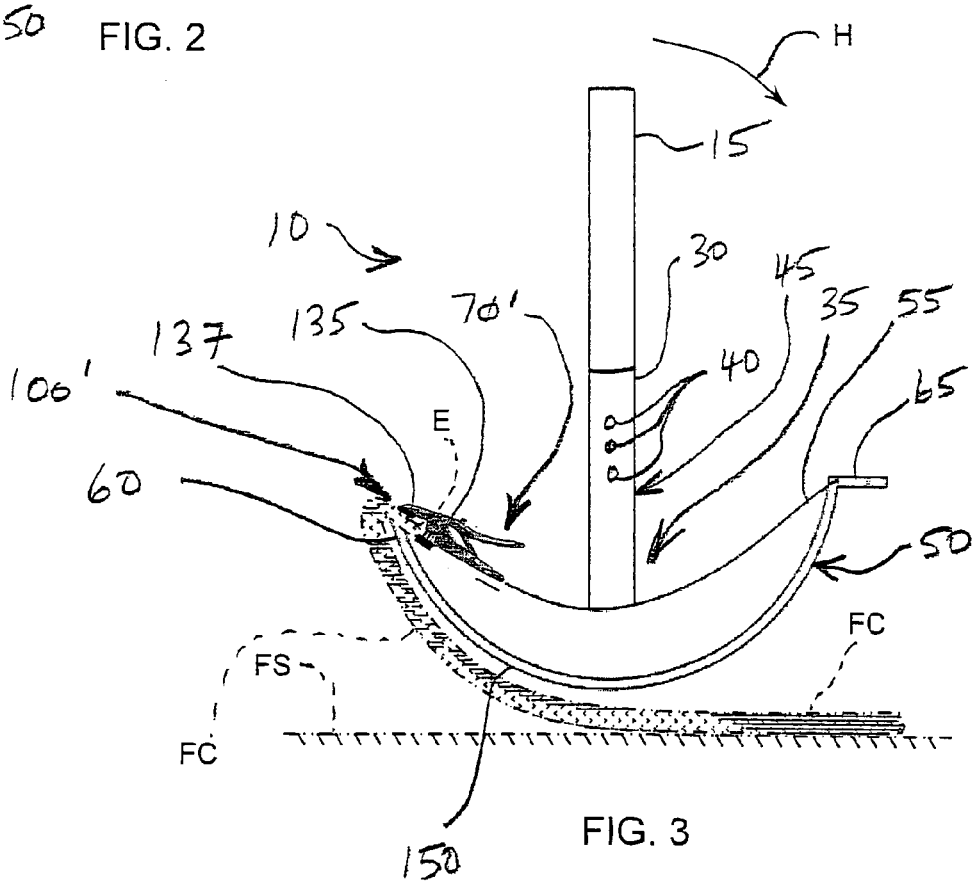
FIG. 3 is an elevation view of the apparatus of FIG. 1 depicting an optionally preferred variation thereof and in use.

With reference to FIG. 3, those with expertise in the field of art will understand that additional modifications to the embodiments comprehended by the invention may further include other types of alternate releasable retainers 70'. In combination with or independent of the clutch 75, a pliers-type clamp mechanism 135 may be used to capture and retain the edge E of the floor covering FC during removal from a floor surface or underlayment FS. For purposes of illustration, the base 50 is shown slightly lifted above the floor covering FC and the floor surface FS. However, in operation, the base 50 will be urged against the floor covering and surface FC, FS while the base 50 is rotated by the handle 15, and also possibly by a user stepping against the step of the fulcrum end 65.

The pliers-type clamp 135 may incorporate one or more movable arms or jaws 137 with open position where the jaws 137 are spaced apart from the grip end 60 to define a clutch recess 100'. In operation with any of the contemplated releasable retainers 70, 70' after the floor covering edge E is received and captured in the clutch recess 100, 100' the hand tool 10 is operated by moving the handle 15 in the direction of arrow "H" (FIG. 3).

Further improvements to the present invention can augment the operational capabilities already described and may include friction-enhancing features that minimize slipping of the arcuate lifting base 50 relative to the surface of the floor covering FC that is in contact with the hand tool 10. In other preferred modifications to the embodiments of the invention, the arcuate base 50 may also be further adapted other anti-slip or friction-enhancing features (not shown) that may be in the form of a rubber face, which may be conformally molded, adhered, applied or otherwise fastened to the outer face 150.

In yet other preferred alternatives, such friction-enhancing, anti-slip features may be selected to be a plurality of spaced apart, friction-enhancing, anti-slip gripping elements 155, such as outwardly projecting, sharp spikes 155 (FIG. 1). The friction enhancers or gripping elements 155 may be integrally formed about the outer face 150, or may alternatively be fastened to and or captured in apertures 160. Other types of friction elements can also be used, such as, for example, anti-skid coatings.

The embodiments of the invention also preferably incorporate configurations that enhance the capability for use in space confined or tight clearance areas. Such difficulties can be encountered in removing floor coverings from stairs, closets, corner areas, and areas where floor covering FC must be removed. The same challenges are confronted where space and clearances are constrained by adjacent structures of the floor surface, such as walls and other features and appurtenances.

Figure 4:
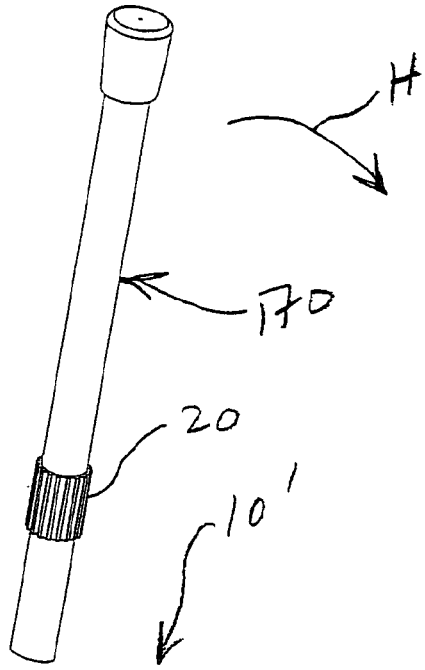
FIG. 4 is a top perspective view of the device of FIGS. 1-3 and illustrating another modification thereof.
Figure 4:
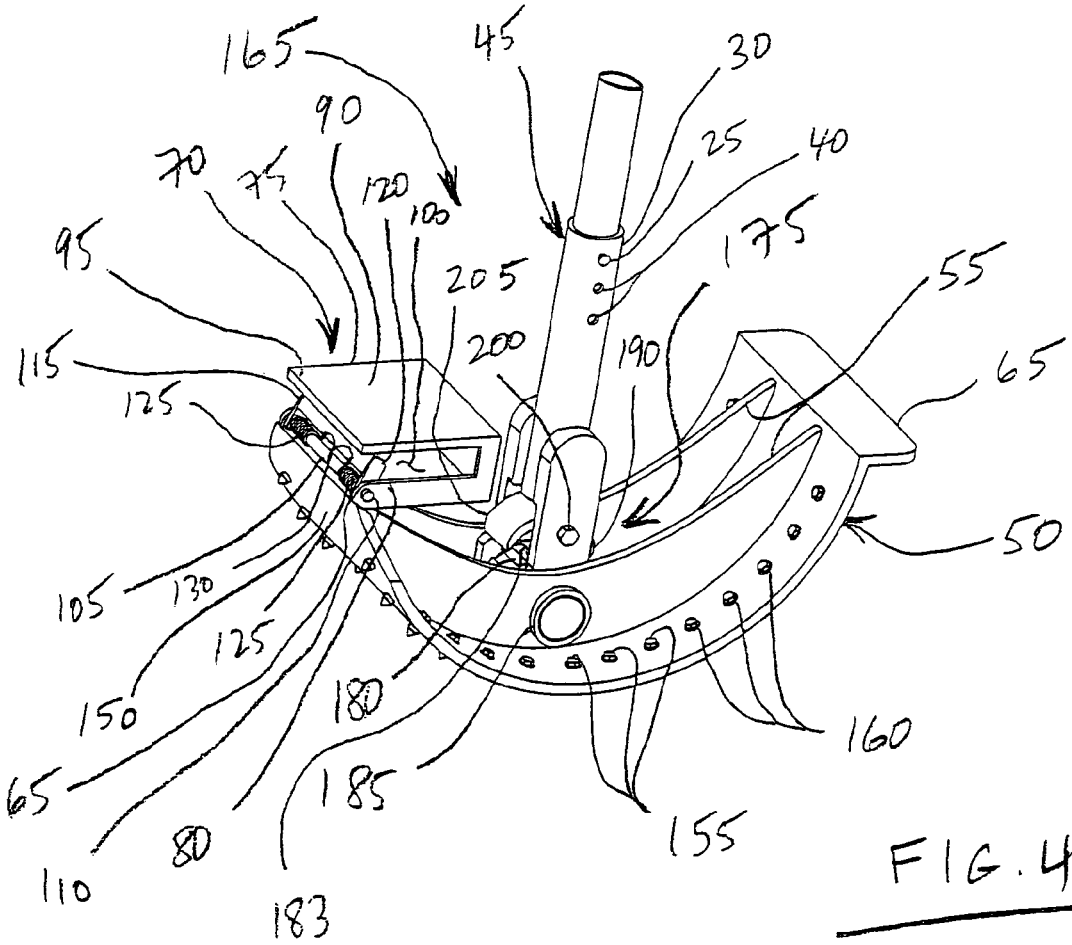

For use in such areas, attention is now invited to FIG. 4, which describes a modified floor covering lifting and removal hand tool 10' that may incorporate a ratcheting handle or lever arm 165 that extends outwardly from the arcuate base 50. In this modified variation of the preferred embodiments of the invention, the ratcheting handle or lever arm 165 is rotatably attached to the arcuate base 50 about the pivot joint 35 and may be joined to the previously described pivot joint 35. More preferably, the ratcheting lever arm 165 extends between the handle portion 170 to a rotatable ratchet assembly 175 adapted with a notched gear 180.

The rotatable ratchet assembly 175 is preferably captured in the pivot joint 35, and more preferably is journalled on a bearing 185 fastened between the flanges 55. The rotatable ratchet assembly 175 is adapted so that the ratchet handle 170 is rotatable while the notched gear 180 is fixed in position, and unable to rotate relative to the arcuate base or rocker 50. Pivotally hinged to the handle 170 is a pawl driver 190 that extends to engage notches 183 of the gear 180. The pawl driver 190 is urged in a releasable but continuously biased position against the notched gear 180 by a pawl spring assembly 200. For positioning the handle 170 to enable use of the hand tool 10' in tight spaces, the pawl driver 190 is urged away from the notched gear and released by a release lever 205.

Figure 5:
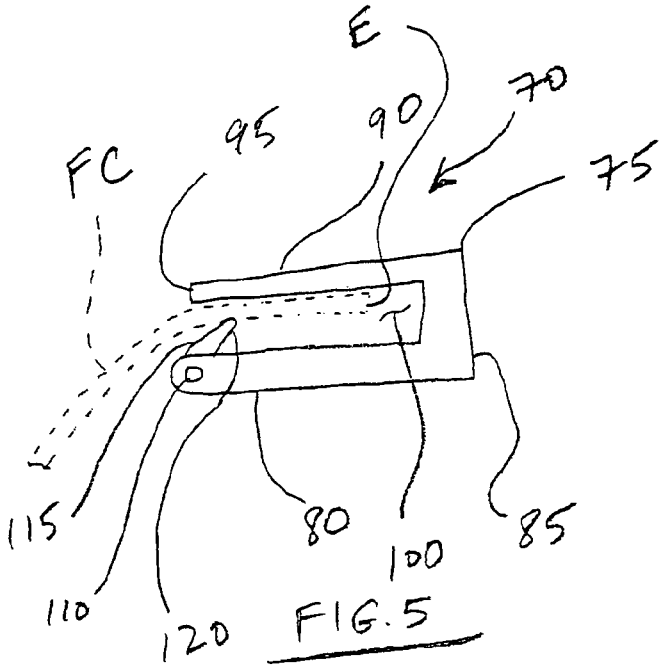
FIG. 5 is an enlarged detail side view of a component of the hand tool in FIG. 4, received with an edge of a floor covering, and with various structure removed for purposes of further illustration.

Once the floor covering edge E is secured to the grip end 60 of the arcuate rocker 50 as shown in the partial detail view of FIG. 5, the ratcheting lever arm 165 is moved about to position within a range of motion that is defined by the configuration of the modified hand tool 10' and the available clearance of the structural surroundings of the area where floor covering FC to be removed. Such ratcheting capabilities are well known to those having knowledge in the relevant fields of technology and the embodiments of the present invention are not intended to be limited by the various ratcheting mechanisms described here. For purposes of further example but not for purposes of limitation, additional types of ratcheting assemblies having features, which may offer alternatives beyond those described herein, are described in U.S. Pat. No. 2,501,253 to Anglemeyer; U.S. Pat. No. 3,727,886 to Cain; and U.S. Pat. No. 3,985,342 to Denman, which are hereby incorporated by reference in their entirety as though fully set forth herein.

In further variations of the methods of operation of the inventive floor covering lifting and removal hand tool 10 of the invention, the edge E of the floor covering FC is accomplished as described elsewhere herein, but without the step of releasing the edge E from the clamp or clutch components. In this optional and alternative method, the edge E is received in the clutch or clamp recess 100, 100' of the releasable retainer 70, 70' and clamp or clutch components 75, 135 are fastened about and or clamped onto the edge E. The lever arm and or adjustable handle 15, or the extend length pivot coupler lever arm or handle 45 are rotated, actuated, or moved to rotate the arcuate base 50 approximately about the pivot point and away from the original position of the edge E.

As described in connection with other varied embodiments, the lever arm 15, 45 is rotated and or moved generally around the pivot joint 35 and toward the floor surface FS, which in turn moves the grip end 60, thereby applying tension that pulls the floor covering FC away from the floor surface FS. Although in previous methods described elsewhere herein, once the desired edge E and or section of the floor covering FC has been pulled away from the floor surface FS, the tension is released and the edge E was removed from the clamp or clutch components 75, 135 before repositioning of the hand tool 10.

In the present alternatively preferred method, the edge E is not released and removed. Instead, the hand tool 100 is repositioned so that the floor covering FC is pulled taut and the steps of rotating, actuating, or moving the lever arm handle 15 or 45 to rotate the arcuate base 50 are accomplished to continue lifting and removing the floor covering FC from the floor surface. This revised method, when coupled with incorporation of the optionally preferred gripping or anti-friction elements 155 about the base 50, enables removal of entire sections of the floor covering FC.

Removal of large or entire sections of the floor covering can be similarly accomplished when it preferred to release the edge E from the releasably retainers 70, 70', reposition the hand tool 10, 10' proximate to a second edge of the floor covering FC. The second edge can be another location about the edge E, and can also be the second edge E that is cut into centrally or anywhere about the floor covering FC to establish the edge E.

With each of these variations, modifications, and preferred embodiments to the invention, those having skill in the art can appreciate that the capability to lift and remove larger sections of floor coverings such as carpeting is easier than it has been previously possible with prior art attempts. More specifically, the adjustable lever arm capability of the telescoping handle 15, the extended pivot coupler 45, and or the ratcheting handle or lever arm 165 cooperatively coact with the arcuate rocker or lifting base 50 to establish the desired mechanical advantage that may be needed for moving larger sections of well-secured or securely glued or fastened floor coverings.

Further, with the small footprint of the arcuate rocker or lifting base 50 and the adjustable length lever arm 15, 45, 165, it is now possible to use the hand tool 10, 10' in previously inaccessible areas, including stairs, ramps, narrow hallways, closets and other comparably confined areas. Notably, with use of the ratcheting handle or lever arm 165 embodiments of the hand tool 10, 10', users are more readily equipped to lift and remove such floor coverings FC in close proximity to structures such as walls, floor mounted fixtures and other obstructions, obstacles, and appurtenances that otherwise would hamper needed clearance for use of previous removal tools.

Although the present invention has been described in detail in connection with the discussed embodiments, various modifications may be made by one of ordinary skill in the art without departing from the spirit and scope of the present invention. Therefore, the scope of the present invention must be determined by the attached claims.

The invention claimed is:

1. A floor covering lifting and removal hand tool for pulling an edge of a floor covering, comprising:

an arcuate lifting base having a first end spaced apart from a second end, said arcuate lifting base including an outer surface with a plurality of spaced apart gripping elements projecting outward and engaging a surface of the floor covering;

a lever arm at one end connected to the arcuate lifting base at a substantially central location of the lifting base between the first and second ends, and extending outwardly therefrom; and a clamping device mounted to the first end defining a recess for receiving the edge of the floor covering and incorporating a catch with a free engagement end movable to receive the edge into the recess to grip the floor covering in a received position.

2. The floor covering lifting and removal hand tool according to claim 1, further comprising:

a bias member positioned to urge the engagement end of the movable catch against the floor covering once received in the recess; and wherein the catch is movable against the force of the bias member to release the floor covering edge.

3. The floor covering lifting and removal hand tool according to claim 2, further comprising:

a clutch defining the clamping device;

a rod carried from the first end to have the clutch and the catch movably hinged thereon; and a plurality of walls forming the clamp device and defining the recess sized to receive and surround a portion of the floor covering edge, one of the walls of the plurality having an outward end extending towards the catch to constrain the range of motion of the catch and to coact therewith to grip the floor covering edge.

4. The floor covering lifting and removal hand tool according to claim 1, further comprising:

a pivot joint formed in the arcuate base between the first and second ends; and an adjustable length handle defining the lever arm and at one end releasably joined to the pivot joint and extending outward to a predetermined mechanical advantage length.

5. The floor covering lifting and removal hand tool according to claim 4, further comprising:

a pivot joint including a pivot coupler extending from the arcuate base and having a plurality of adjustment apertures, the pivot coupler sized to telescopically receive the adjustable length handle; and wherein the adjustable length handle has a bayonet end sized for receipt in the pivot coupler and that includes at least one spring biased plunger sized for releasable receipt in at least one of the plurality of adjustment apertures.

6. The floor covering lifting and removal hand tool according to claim 5, further comprising:

a pair of load distribution flanges extending between the first and second ends and across the arcuate lifting base about opposite sides of the pivot coupler.

7. The floor covering lifting and removal hand tool according to claim 1, further comprising:

a clutch defining the clamping device that includes a pivotable mount side wall hinged about a rod carried from the first end and extending to a back wall that connects to an outer wall substantially parallel to the pivotable mount side wall, the outer wall extending to a free end, and the walls cooperating to define the recess for receiving the edge of the floor covering;

a bias member positioned to urge the engagement end of the movable catch against the free engagement end of the outer wall; and wherein the movable catch is constrained within the recess to deflect as the floor covering edge is received between the free engagement end and the free end of the outer wall, and to grip the floor covering edge as the bias member urges the free engagement end against the floor covering.

8. The floor covering lifting and removal hand tool according to claim 1, further comprising:

at least one load distribution flange extending between the first and second ends and across the arcuate lifting base, the at least one flange being further joined to the lever arm.

9. The floor covering lifting and removal hand tool according to claim 1, wherein the movable catch is at least one movable jaw mounted to the arcuate base proximate to the first end and extending to define the recess, the at least one movable jaw coactive with the first end to clamp the edge of the floor covering to the arcuate base.

10. A floor covering lifting and removal hand tool for pulling an edge of a floor covering, comprising:

an arcuate lifting base formed with a first end spaced apart from a second end;

a ratcheting lever arm extending outwardly from and hinged to the arcuate base; and a releasable clamp carried from the first end and defining a recess sized to receive the floor covering edge, the releasable clamp including a movable catch with a free engagement end hinged to deflect as the edge is received into the recess, the free engagement end urged to grip the edge of the received floor covering.

11. The floor covering lifting and removal hand tool according to claim 10, further comprising:

at least one movable jaw defining the movable catch and connected to the arcuate lifting base with the free engagement end spaced apart from the first end in an open position to define the recess; and wherein the jaw closes and the free engagement end coacts with the first end to releasably clamp the floor covering edge.

12. The floor covering lifting and removal hand tool according to claim 10, wherein the arcuate lifting base includes an outer surface with a plurality of spaced apart gripping elements projecting outward and engaging a surface of the floor covering.

13. The floor covering lifting and removal hand tool according to claim 10, further comprising:

an adjustable handle releasably joined to the ratcheting lever arm and extending further outward with a predetermined mechanical advantage length.

14. The floor covering lifting and removal hand tool according to claim 10, further comprising:

the ratcheting lever arm including a notched ratchet wheel fixed in position relative to the arcuate lifting base; and at least one pawl positioned to releasably engage the notches to prevent rotation in at least one direction of the ratcheting lever arm relative to the ratchet wheel.

15. The floor covering lifting and removal hand tool according to claim 14, further comprising:

at least one movable jaw defining the movable catch and connected to the arcuate lifting base with the free engagement end spaced apart from the first end in an open position to define the recess; and wherein the jaw closes and the free engagement end coacts with the first end to releasably clamp the floor covering edge.

16. The floor covering lifting and removal hand tool according to claim 10, further comprising:

the ratcheting lever arm including a notched ratchet wheel and at least one pawl positioned to releasably engage the notches to prevent rotation in at least one direction of the ratcheting lever arm relative to the ratchet wheel; and a bias element urging the pawl against the notches, to impart single direction relative rotation between the ratcheting lever arm and the ratchet wheel.

17. The floor covering lifting and removal hand tool according to claim 16, wherein the arcuate lifting base includes an outer surface with a plurality of spaced apart gripping elements projecting outward and engaging a surface of the floor covering.

18. A method for removing a portion of a floor covering bonded to a floor surface using a floor covering lifting and removal hand tool for pulling an edge of a floor covering that includes an arcuate lifting base having a first end spaced apart from a second end; a lever arm at one end connected to the arcuate lifting base at a substantially central location of the lifting base between the first and second ends, and extending outwardly therefrom; and a clamping device mounted to the first end and defining a recess for receiving the edge of the floor covering and incorporating a catch with a free engagement end movable to receive the edge into the recess and to grip the floor covering in a received position;

the method including the steps of:

a) positioning the floor covering lifting and removal hand tool about a first edge of the floor covering and clamping the edge in the clamping device;

b) rotating the lever arm toward the floor surface and away from the first edge to apply tension to and to pull the floor covering away from the floor surface;

c) urging the catch away from the floor covering edge to release the edge from the clamping device;

d) releasing the tension on the floor covering by rotating the lever toward the floor covering edge; and e) prior to step c, repositioning the floor covering lifting and removal hand tool about the floor surface to retension the floor covering and repeating step b of the method.

19. A floor covering lifting and removal hand tool for pulling an edge of a floor covering, comprising:

an arcuate lifting base having a first end spaced apart from a second end;

a lever arm at one end connected to the arcuate lifting base between the first and second ends, and extending outwardly therefrom; and a clamping device mounted to the first end defining a recess for receiving the edge of the floor covering and incorporating a catch with a free engagement end movable to receive the edge into the recess to grip the floor covering in a received position, wherein the arcuate lifting base includes an outer surface with a plurality of spaced apart gripping elements projecting outward and engaging a surface of the floor covering.

20. The floor covering lifting and removal hand tool according to claim 19, wherein the catch is movable.

21. A floor covering lifting and removal hand tool for pulling an edge of a floor covering, comprising:

an arcuate lifting base having a first end spaced apart from a second end;

a lever arm at one end connected to the arcuate lifting base between the first and second ends, and extending outwardly therefrom; and a clamping device mounted to the first end defining a recess for receiving the edge of the floor covering and incorporating a catch with a free engagement end movable to receive the edge into the recess to grip the floor covering in a received position, wherein the floor covering lifting and removal hand tool further comprises at least one load distribution flange extending between the first and second ends and across the arcuate lifting base, the at least one flange being further joined to the lever arm.

22. The floor covering lifting and removal hand tool according to claim 21, wherein the catch is movable.

23. A method for removing a portion of a floor covering bonded to a floor surface using a floor covering lifting and removal hand tool for pulling an edge of a floor covering that includes an arcuate lifting base having a first end spaced apart from a second end; a lever arm at one end connected to the arcuate lifting base between the first and second ends, and extending outwardly therefrom; and a clamping device mounted to the first end and defining a recess for receiving the edge of the floor covering and incorporating a catch with a free engagement end movable to receive the edge into the recess and to grip the floor covering in a received position;

the method including the steps of:

a) positioning the floor covering lifting and removal hand tool about a first edge of the floor covering and clamping the edge in the clamping device;

b) rotating the lever arm toward the floor surface and away from the first edge to apply tension to and to pull the floor covering away from the floor surface;

c) urging the movable catch away from the floor covering edge to release the edge from the clamping device;

d) releasing the tension on the floor covering by rotating the lever toward the floor covering edge; and e) prior to step c), repositioning the floor covering lifting and removal hand tool about the floor surface to retension the floor covering and repeating step b) of the method.

24. The method according to claim 23, wherein the catch is movable.

* * * * *

UNITED STATES PATENT AND TRADEMARK OFFICE

CERTIFICATE OF CORRECTION

PATENT NO. : 7,655,109 B2
APPLICATION NO. : 11/368737
DATED : February 2, 2010
INVENTOR(S) : Herbert C. Manners It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 837 days.

Signed and Sealed this

Twenty-third Day of November, 2010

David J. Kappos

David J. Kappos
*Director of the United States Patent and Trademark Office*